US010757501B2

(12) United States Patent
Mehra et al.

(10) Patent No.: US 10,757,501 B2
(45) Date of Patent: Aug. 25, 2020

(54) HYBRID AUDIO SYSTEM FOR EYEWEAR DEVICES

(71) Applicant: Facebook Technologies, LLC, Menlo Park, CA (US)

(72) Inventors: Ravish Mehra, Redmond, WA (US); Antonio John Miller, Sammamish, WA (US); Morteza Khaleghimeybodi, Bellevue, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/967,924

(22) Filed: May 1, 2018

(65) Prior Publication Data

US 2019/0342647 A1 Nov. 7, 2019

(51) Int. Cl.

| | |
|---|---|
| ***H04R 25/00*** | (2006.01) |
| ***H04R 1/10*** | (2006.01) |
| ***H04R 1/02*** | (2006.01) |
| ***H04R 17/00*** | (2006.01) |

(52) U.S. Cl.

CPC ..... *H04R 1/105* (2013.01); *H04R 1/028* (2013.01); *H04R 17/00* (2013.01); *H04R 2400/03* (2013.01); *H04R 2460/13* (2013.01)

(58) Field of Classification Search

CPC ..... H04R 1/105; H04R 1/028; H04R 17/00; H04R 2400/03; H04R 2460/13

USPC ..... 381/327, 326, 380–381

See application file for complete search history.

(56) References Cited

U.S. PATENT DOCUMENTS

| | | | |
|---|---|---|---|
| 1,983,178 | A | 12/1934 | Lybarger |
| 5,867,582 | A | 2/1999 | Nagayoshi |
| 8,977,376 | B1 | 3/2015 | Lin et al. |
| 9,648,438 | B1 | 5/2017 | Petrov |
| 2008/0037801 | A1 | 2/2008 | Alves et al. |
| 2010/0174767 | A1 | 7/2010 | Villemoes |

(Continued)

FOREIGN PATENT DOCUMENTS

| | | | |
|---|---|---|---|
| EP | 3445066 | A1 | 2/2019 |
| KR | 20160111280 | A | 9/2016 |

OTHER PUBLICATIONS

PCT International Search Report and Written Opinion, PCT Application No. PCT/US2019/026944, dated Jun. 14, 2019, 42 pages.

*Primary Examiner* — Suhan Ni
(74) *Attorney, Agent, or Firm* — Fenwick & West LLP

(57) ABSTRACT

An audio system for providing content to a user. The system includes a first and a second transducer assembly of a plurality of transducer assemblies, an acoustic sensor, and a controller. The first transducer assembly couples to a portion of an auricle of the user's ear and vibrates over a first range of frequencies based on a first set of audio instructions. The vibration causes the portion of the ear to create a first range of acoustic pressure waves. The second transducer assembly is configured to vibrate over a second range of frequencies to produce a second range of acoustic pressure waves based on a second set of audio instructions. The acoustic sensor detects acoustic pressure waves at an entrance of the ear. The controller generates the audio instructions based on audio content to be provided to the user and the detected acoustic pressure waves from the acoustic sensor.

20 Claims, 5 Drawing Sheets

(56) References Cited

U.S. PATENT DOCUMENTS

| | | | | |
|---|---|---|---|---|
| 2011/0301729 | A1* | 12/2011 | Heiman | H04S 7/301 700/94 |
| 2012/0177209 | A1 | 7/2012 | Goldstein et al. | |
| 2013/0051585 | A1* | 2/2013 | Karkkainen | H04R 1/1075 381/151 |
| 2013/0216052 | A1 | 8/2013 | Bruss et al. | |
| 2014/0363003 | A1 | 12/2014 | Kupershmidt et al. | |
| 2015/0181338 | A1 | 6/2015 | Hosoi et al. | |
| 2015/0271590 | A1 | 9/2015 | Nakagawa et al. | |
| 2017/0228995 | A1* | 8/2017 | Hosoi | G08B 21/02 |
| 2018/0227687 | A1 | 8/2018 | Thomson | |

* cited by examiner

HYBRID AUDIO SYSTEM FOR EYEWEAR DEVICES

BACKGROUND

This disclosure relates generally to an audio system in an eyewear device, and specifically relates to a hybrid audio system for use in eyewear devices.

Head-mounted displays in an artificial reality system often include features such as speakers or personal audio devices to provide audio content to users of the head-mounted displays. The audio devices ideally operate over the full range of human hearing while balancing being lightweight, ergonomic, low in power consumption, and minimizing crosstalk between the ears. Traditional audio devices utilize one mode of sound conduction (e.g., speakers through air conduction); however, only one mode of sound conduction may put some limits on the performance of the device, such that not all the frequency contents can be delivered using one mode of conduction. This is especially important when the user's ears need to remain in contact with the sound conduction transducer assembly and cannot be occluded.

SUMMARY

This present disclosure describes an audio system comprising a plurality of transducer assemblies configured to provide audio content. The audio system may be a component of an eyewear device which may be a component of an artificial reality head-mounted display (HMD). Of the plurality of transducer assemblies, the audio system comprises a first transducer assembly coupled to a portion of an ear of a user of the audio system. The first transducer assembly comprises at least one transducer that is configured to vibrate the portion of the ear over a first range of frequencies to cause the portion of the ear to create a first range of acoustic pressure waves at an entrance to the user's ear according to a first set of audio instructions. The audio system comprises a second transducer assembly including at least one transducer that vibrates over a second range of frequencies to produce a second range of acoustic pressure waves at the entrance of the user's ear according to a second set of audio instructions. The audio system includes a controller coupled to the plurality of transducer assemblies and generates the first set and the second set of audio instructions such that the first range and the second range of acoustic pressure waves together form at least a portion of audio content to be provided to the user.

In additional embodiments, the audio system comprises an acoustic sensor configured to detect acoustic pressure waves at the entrance of the user's ear, wherein the detected acoustic pressure waves include the first range and the second range of acoustic pressure waves. In additional embodiments, there is a third transducer assembly in the plurality of transducer assemblies that is coupled to a portion of the user's skull bone behind the user's ear or in front of it on a condyle and configured to vibrate the bone over a third range of frequencies according to a third set of audio instructions.

Additionally, the audio system can update audio instructions. To monitor resulting acoustic pressure waves at an entrance of the user's ear due to the cartilage conduction transducer assembly and the air conduction transducer assembly, the audio system additionally comprises an acoustic sensor for detecting the acoustic pressure waves. As the controller receives feedback from the acoustic sensor, the controller can generate a frequency response model. The frequency response model compares the detected acoustic pressure waves to the audio content to be provided to the user. The controller can then update the audio instructions based in part on the frequency response model.

Figure 1:
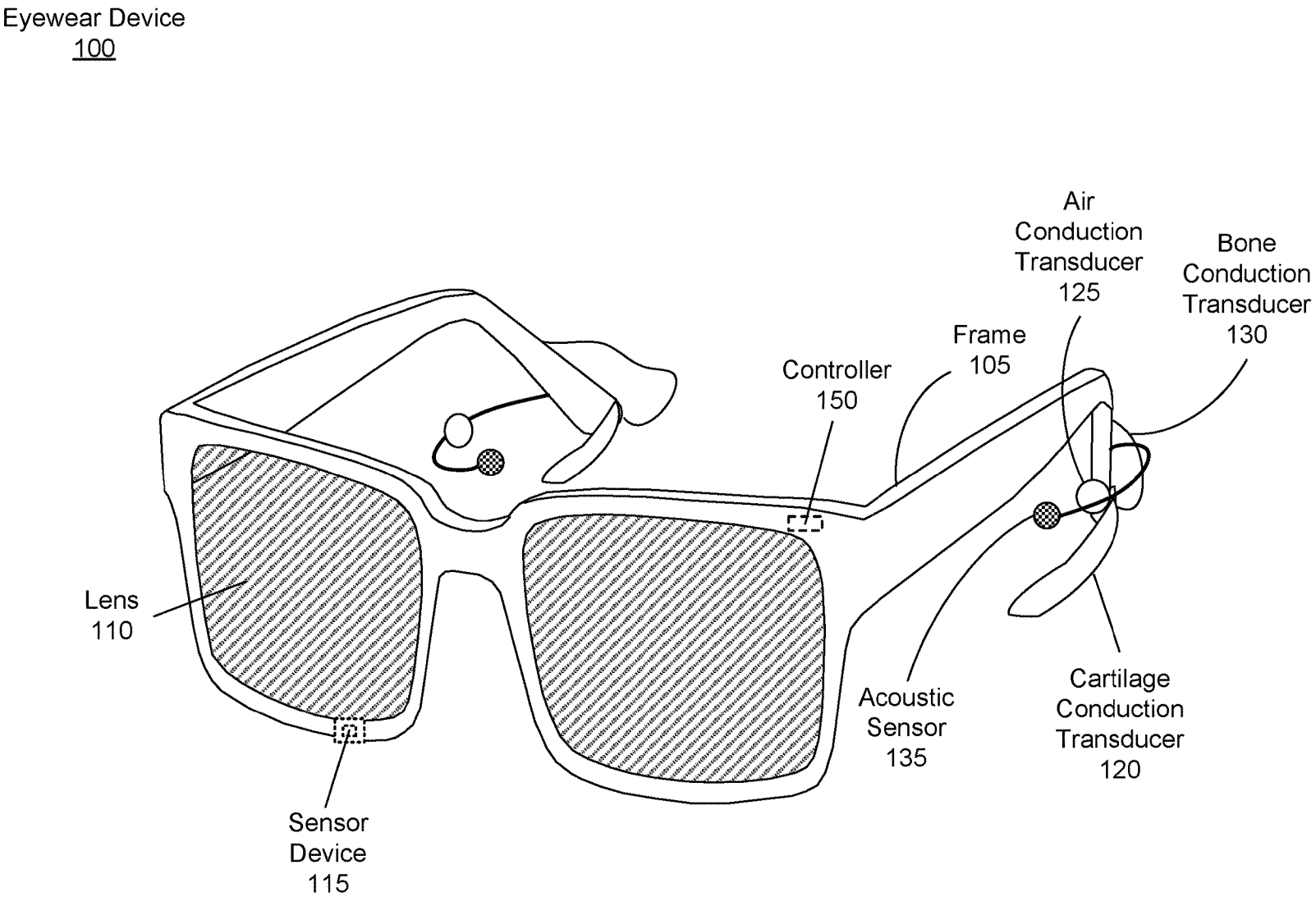
FIG. 1 is a perspective view of an eyewear device including an audio system, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the invention may include or be implemented in conjunction with an artificial reality system. Artificial reality is a form of reality that has been adjusted in some manner before presentation to a user, which may include, e.g., a virtual reality, an augmented reality, a mixed reality, a hybrid reality, or some combination and/or derivatives thereof. Artificial reality content may include completely generated content or generated content combined with captured (e.g., real-world) content. The artificial reality content may include video, audio, haptic sensation, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including an eyewear device, a head-mounted display (HMD) assembly with the eyewear device as a component, a HMD connected to a host computer system, a standalone HMD, a mobile device or computing system, or any other hardware platform capable of providing artificial reality content to one or more viewers.

System Architecture

A hybrid audio system (audio system) uses at least cartilage conduction and air conduction for providing sound to an ear of a user. The audio system comprises a plurality of transducer assemblies—one of which is configured for cartilage conduction and another of which is configured for air conduction. The audio system may additionally comprise a third transducer assembly of the plurality of transducer assemblies configured for bone conduction. Each type of transduction assembly operates differently from the others. The cartilage conduction transducer assembly vibrates a pinna of the user's ear for creating an airborne acoustic pressure wave at an entrance of the ear that travels down an ear canal to an eardrum where it is perceived as sound by the user, wherein airborne refers to an acoustic pressure wave which travels through air in the ear canal which then vibrates the eardrum, and these vibrations are turned into signals by the cochlea (also referred to as the inner ear) which the brain perceives as sound. The air conduction transducer assembly directly creates an airborne acoustic pressure wave at the entrance of the ear which also travels to the eardrum and perceived in the same fashion as cartilage conduction. The bone conduction transducer assembly vibrates the bone to create a tissue-borne and then, bone-borne acoustic pressure wave that is conducted by the tissue/bone of the head (bypassing the eardrum) to the cochlea. The cochlea turns the bone-borne acoustic pressure wave into signals which the brain perceives as sound. A tissue-borne acoustic pressure wave refers to an acoustic pressure wave that is transmitted via tissue and is for presenting audio content to a user. Advantages of an audio system that uses a combination of these methods to provide audio content to the user allows for the audio system to designate varying methods for varying ranges of the total range of human hearing. In one embodiment, the audio system may operate a bone conduction transducer assembly over a lowest range of frequencies, a cartilage conduction transducer assembly over a medium range of frequencies, and an air conduction transducer assembly over a highest range of frequencies.

FIG. 1 is a perspective view of an eyewear device 100 including an audio system, in accordance with one or more embodiments. The eyewear device 100 presents media to a user. In one embodiment, the eyewear device 100 may be a component of or in itself a head-mounted display (HMD). Examples of media presented by the eyewear device 100 include one or more images, video, audio, or some combination thereof. The eyewear device 100 may include, among other components, a frame 105, a lens 110, a sensor device 115, a cartilage conduction transducer assembly 120, an air conduction transducer assembly 125, a bone conduction transducer assembly 130, an acoustic sensor 135, and a controller 150.

The eyewear device 100 may correct or enhance the vision of a user, protect the eye of a user, or provide images to a user. The eyewear device 100 may be eyeglasses which correct for defects in a user's eyesight. The eyewear device 100 may be sunglasses which protect a user's eye from the sun. The eyewear device 100 may be safety glasses which protect a user's eye from impact. The eyewear device 100 may be a night vision device or infrared goggles to enhance a user's vision at night. The eyewear device 100 may be a HMD that produces artificial reality content for the user. Alternatively, the eyewear device 100 may not include a lens 110 and may be a frame 105 with an audio system that provides audio (e.g., music, radio, podcasts) to a user.

The frame 105 includes a front part that holds the lens 110 and end pieces to attach to the user. The front part of the frame 105 bridges the top of a nose of the user. The end pieces (e.g., temples) are portions of the frame 105 to which the temples of a user are attached. The length of the end piece may be adjustable (e.g., adjustable temple length) to fit different users. The end piece may also include a portion that curls behind the ear of the user (e.g., temple tip, ear piece).

The lens 110 provides or transmits light to a user wearing the eyewear device 100. The lens 110 is held by a front part of the frame 105 of the eyewear device 100. The lens 110 may be prescription lens (e.g., single vision, bifocal and trifocal, or progressive) to help correct for defects in a user's eyesight. The prescription lens transmits ambient light to the user wearing the eyewear device 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional detail regarding the lens 110 can be found in the detailed description of FIG. 5.

The sensor device 115 estimates a current position of the eyewear device 100 relative to an initial position of the eyewear device 100. The sensor device 115 may be located on a portion of the frame 105 of the eyewear device 100. The sensor device 115 includes a position sensor and an inertial measurement unit. Additional details about the sensor device 115 can be found in the detailed description of FIG. 5.

The audio system of the eyewear device 100 comprises a plurality of transducer assemblies configured to provide audio content to a user of the eyewear device 100. In the illustrated embodiment of FIG. 1, the audio system of the eyewear device 100 includes the cartilage conduction transducer assembly 120, the air conduction transducer assembly 125, the bone conduction transducer assembly 130, the acoustic sensor 135, and the controller 150. The audio system provides audio content to a user by utilizing some combination of the cartilage conduction transducer assembly 120, the air conduction transducer assembly 125, and the bone conduction transducer assembly 130. The audio system also uses feedback from the acoustic sensor 135 to create a similar audio experience across different users. The controller 150 manages operation of the transducer assemblies by generating audio instructions. The controller 150 also receives feedback as monitored by the acoustic sensor 135, e.g., for updating the audio instructions. Additional detail regarding the audio system can be found in the detailed description of FIG. 3.

The cartilage conduction transducer assembly 120 produces sound by vibrating cartilage in the ear of the user. The cartilage conduction transducer assembly 120 is coupled to an end piece of the frame 105 and is configured to be coupled to the back of an auricle of the ear of the user. The auricle is a portion of the outer ear that projects out of a head of the user. The cartilage conduction transducer assembly 120 receives audio instructions from the controller 150. Audio instructions may include a content signal, a control signal, and a gain signal. The content signal may be based on audio content for presentation to the user. The control signal may be used to enable or disable the cartilage conduction transducer assembly 120 or one or more transducers of the transducer assembly. The gain signal may be used to adjust an amplitude of the content signal. The cartilage conduction transducer assembly 120 vibrates the auricle to generate an airborne acoustic pressure wave at an entrance of the user's ear. The cartilage conduction transducer assembly 120 may include one or more transducers to cover different parts of a frequency range. For example, a piezoelectric transducer may be used to cover a first part of a frequency range and a moving coil transducer may be used to cover a second part of a frequency range. Additional detail regarding the cartilage conduction transducer assembly 120 can be found in the detailed description of FIG. 3.

The air conduction transducer assembly 125 produces sound by generating an airborne acoustic pressure wave in the ear of the user. The air conduction transducer assembly 125 is coupled to an end piece of the frame 105 and is placed in front of an entrance to the ear of the user. The air conduction transducer assembly 125 also receives audio instructions from the controller 150. The air conduction transducer assembly 125 may include one or more transducers to cover different parts of a frequency range. For example, a piezoelectric transducer may be used to cover a first part of a frequency range and a moving coil transducer may be used to cover a second part of a frequency range. Additional detail regarding the air conduction transducer assembly 125 can be found in the detailed description of FIG. 3.

The bone conduction transducer assembly 130 produces sound by vibrating bone in the user's head. The bone conduction transducer assembly 130 is coupled to an end piece of the frame 105 and is configured to be behind the auricle coupled to a portion of the user's bone. The bone conduction transducer assembly 130 also receives audio instructions from the controller 150. The bone conduction transducer assembly 130 vibrates the portion of the user's bone which generates a tissue-borne acoustic pressure wave that propagates toward the user's cochlea, thereby bypassing the eardrum. The bone conduction transducer assembly 130 may include one or more transducers to cover different parts of a frequency range. For example, a piezoelectric transducer may be used to cover a first part of a frequency range and a moving coil transducer may be used to cover a second part of a frequency range. Additional detail regarding the air conduction transducer assembly 125 can be found in the detailed description of FIG. 3.

The acoustic sensor 135 detects an acoustic pressure wave at the entrance of the ear of the user. The acoustic sensor 135 is coupled to an end piece of the frame 105. The acoustic sensor 135, as shown in FIG. 1, is a microphone which may be positioned at the entrance of the user's ear. In this embodiment, the microphone may directly measure the acoustic pressure wave at the entrance of the ear of the user.

Alternatively, the acoustic sensor 135 is a vibration sensor that is configured to be coupled to the back of the auricle of the user. The vibration sensor may indirectly measure the acoustic pressure wave at the entrance of the ear. For example, the vibration sensor may measure a vibration that is a reflection of the acoustic pressure wave at the entrance of the ear and/or measure a vibration created by the transducer assembly on the auricle of the ear of the user which may be used to estimate the acoustic pressure wave at the entrance of the ear. In one embodiment, a mapping between acoustic pressure generated at the entrance to the ear canal and a vibration level generated on the auricle is an experimentally determined quantity that is measured on a representative sample of users and stored. This stored mapping between the acoustic pressure and vibration level (e.g., frequency dependent linear mapping) of the auricle is applied to a measured vibration signal from the vibration sensor which serves as a proxy for the acoustic pressure at the entrance of the ear canal. The vibration sensor can be an accelerometer or a piezoelectric sensor. The accelerometer may be a piezoelectric accelerometer or a capacitive accelerometer. The capacitive accelerometer senses change in capacitance between structures which can be moved by an accelerative force. In some embodiments, the acoustic sensor 135 is removed from the eyewear device 100 after calibration. Additional detail regarding the acoustic sensor 135 can be found in the detailed description of FIG. 3.

The controller 150 provides audio instructions to the plurality of transducer assemblies and receives information from the acoustic sensor 135 regarding the produced sound, and updates the audio instructions based on the received information. The audio instructions may be generated by the controller 150. The controller 150 may receive audio content (e.g., music, calibration signal) from a console for presentation to a user and generate audio instructions based on the received audio content. Audio instructions instruct each transducer assembly how to produce vibrations. For example, audio instructions may include a content signal (e.g., a target waveform based on the audio content to be provided), a control signal (e.g., to enable or disable the transducer assembly), and a gain signal (e.g., to scale the content signal by increasing or decreasing an amplitude of the target waveform). The controller 150 also receives information from the acoustic sensor 135 that describes the produced sound at an ear of the user. In one embodiment, the controller 150 receives monitored vibration of an auricle by the acoustic sensor 135 and applies a previously stored frequency dependent linear mapping of pressure to vibration to determine the acoustic pressure wave at the entrance of the ear based on the monitored vibration. The controller 150 uses the received information as feedback to compare the produced sound to a target sound (e.g., audio content) and updates the audio instructions to make the produced sound closer to the target sound. For example, the controller 150 updates audio instructions for a cartilage conduction transducer assembly to adjust vibration of the auricle of the user's ear to come closer to the target sound. The controller 150 is embedded into the frame 105 of the eyewear device 100. In other embodiments, the controller 150 may be located in a different location. For example, the controller 150 may be part of the transducer assembly or located external to the eyewear device 100. Additional detail regarding the controller 150 and the controller's 150 operation with other components of the audio system can be found in the detailed description of FIGS. 3 & 4.

Hybrid Audio System

Figure 2:
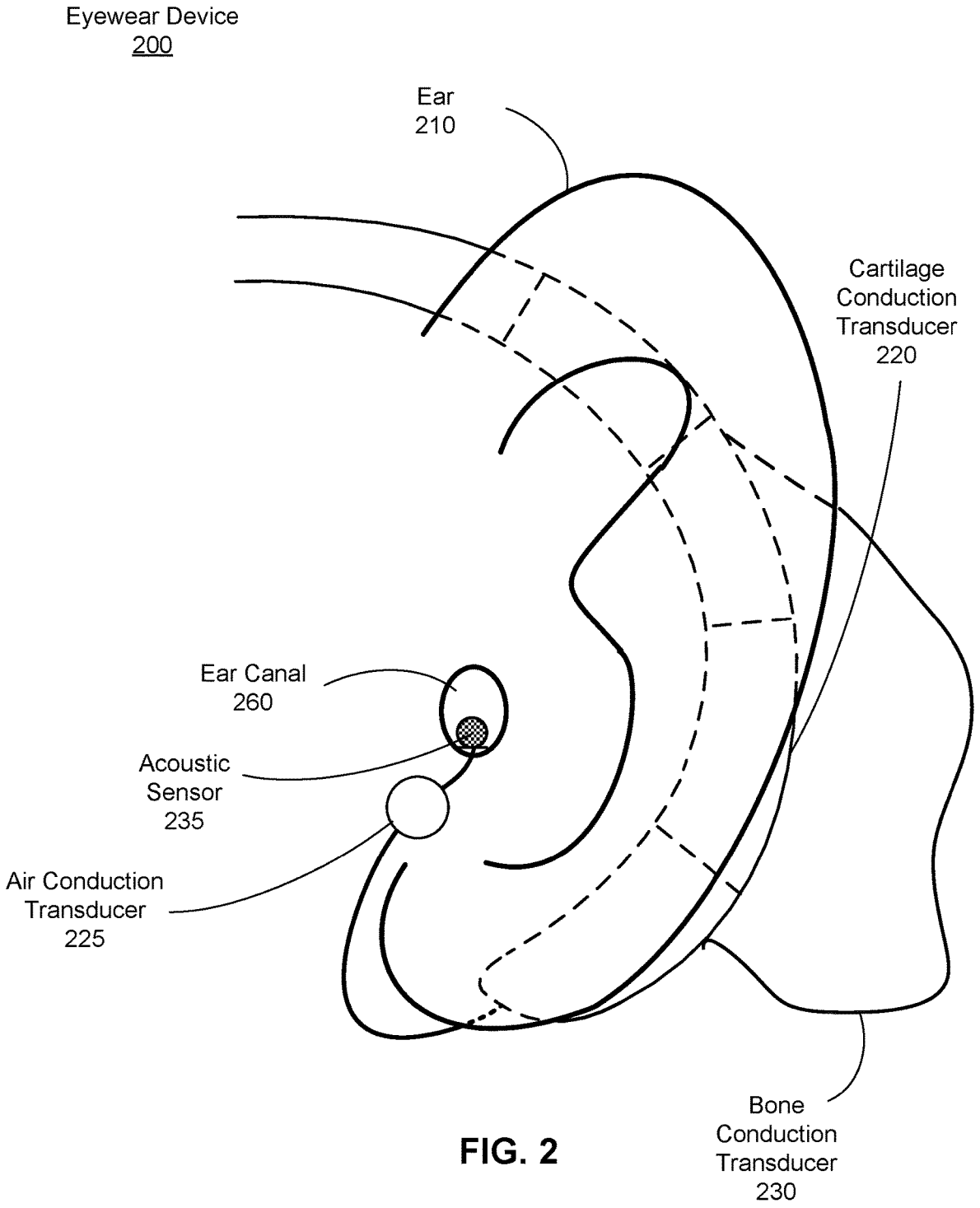
FIG. 2 is a profile view a portion of an audio system as a component of an eyewear device, in accordance with one or more embodiments.

FIG. 2 is a profile view 200 of a portion of an audio system as a component of an eyewear device (e.g., the eyewear device 100), in accordance with one or more embodiments. A cartilage conduction transducer assembly 220, an air conduction transducer assembly 225, a bone conduction transducer assembly 230, and an acoustic sensor 235 are embodiments of the cartilage conduction transducer assembly 120, the air conduction transducer assembly 125, the bone conduction transducer assembly 130, and the acoustic sensor 135, respectively. The cartilage conduction transducer assembly 220 is coupled to a back of an auricle of an ear 210 of a user. The cartilage conduction transducer assembly 220 vibrates the back of auricle of the ear 210 of a user at a first range of frequencies to generate a first range of airborne acoustic pressure waves at an entrance of the ear 210 based on audio instructions (e.g., from the controller). The air conduction transducer assembly 220 is a speaker (e.g., a voice coil transducer) that vibrates over a second range of frequencies to generate a second range of airborne acoustic pressure waves at the entrance of the ear. The first range of airborne acoustic pressure waves and the second range of airborne acoustic pressure waves travel from the entrance of the ear 210 down an ear canal 260 where an eardrum is located. The eardrum vibrates due to fluctuations of the airborne acoustic pressure waves which are then detected as sound by a cochlea of the user (not shown in FIG. 2). The acoustic sensor 235 is a microphone positioned at the entrance of the ear 210 of the user to detect the acoustic pressure waves produced by the cartilage conduction transducer assembly 220 and the air conduction transducer assembly 225.

The bone conduction transducer assembly 230 is coupled to a portion of the user's bone behind the user's ear 210. The bone conduction transducer assembly 230 vibrates over a third range of frequencies. The bone conduction transducer assembly 230 vibrates the portion of the bone to which it is coupled. The portion of the bone conducts the vibrations to create a third range of tissue-borne acoustic pressure waves at the cochlea which is then perceived by the user as sound. Although the portion of the audio system, as shown in FIG. 2, illustrates one cartilage conduction transducer assembly 120, one air conduction transducer assembly 125, one bone conduction transducer assembly 130, and one acoustic sensor 135 configured to produce audio content for one ear 210 of the user, other embodiments include an identical setup to produce audio content for the other ear of the user. Other embodiments of the audio system comprise any combination of one or more cartilage conduction transducer assemblies, one or more air conduction transducer assemblies, and one or more bone conduction transducer assemblies. Examples of the audio system include a combination of cartilage conduction and bone conduction, another combination of air conduction and bone conduction, another combination of air conduction and cartilage conduction, etc.

Figure 3:
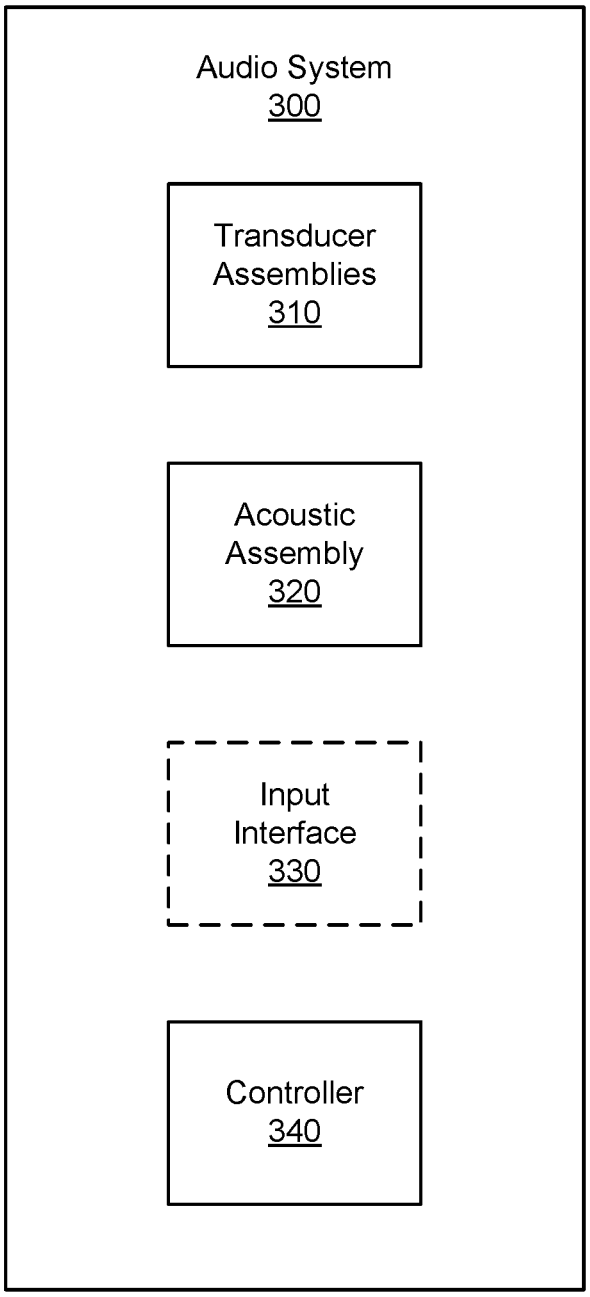
FIG. 3 is a block diagram of an audio system, in accordance with one or more embodiments.

FIG. 3 is a block diagram of an audio system, in accordance with one or more embodiments. The audio system in FIG. 1 is an embodiment of the audio system 300. The audio system 300 includes a plurality of transducer assemblies 310, an acoustic assembly 320, and a controller 340. In one embodiment, the audio system 300 further comprises an input interface 330. In other embodiments, the audio system 300 can have any combination of the components listed with any additional components.

The plurality of transducer assemblies 310 comprises any combination of one or more cartilage conduction transducer assemblies, one or more air conduction transducer assemblies, and one or more bone conduction transducer assemblies, in accordance with one or more embodiments. The plurality of transducer assemblies 310 provide sound to a user over a total range of frequencies. For example, the total range of frequencies is 20 Hz-20 kHz, generally around the average range of human hearing. Each transducer assembly of the plurality of transducer assemblies 310 comprises one or more transducers configured to vibrate over various ranges of frequencies. In one embodiment, each transducer assembly of the plurality of transducer assemblies 310 operates over the total range of frequencies. In other embodiments, each transducer assembly operates over a subrange of the total range of frequencies. In one embodiment, one or more transducer assemblies operate over a first subrange and one or more transducer assemblies operate over a second subrange. For example, a first transducer assembly is configured to operate over a low subrange (e.g., 20 Hz-500 Hz) while a second transducer assembly is configured to operate over a medium subrange (e.g., 500 Hz-8 kHz) and a third transducer assembly is configured to operate over a high subrange (e.g., 8 kHz-20 kHz). In another embodiment, subranges for the transducer assemblies 310 partially overlap with one or more other subranges.

In some embodiments, the transducer assemblies 310 includes a cartilage conduction transducer assembly. A cartilage conduction transducer assembly is configured to vibrate a cartilage of a user's ear in accordance with audio instructions (e.g., received from the controller 340). The cartilage conduction transducer assembly is coupled to a portion of a back of an auricle of an ear of a user. The cartilage conduction transducer assembly includes at least one transducer to vibrate the auricle over a first frequency range to cause the auricle to create an acoustic pressure wave in accordance with the audio instructions. Over the first frequency range, the cartilage conduction transducer assembly can vary amplitude of vibration to affect amplitude of acoustic pressure waves produced. For example, the cartilage conduction transducer assembly is configured to vibrate the auricle over a first frequency subrange of 500 Hz-8 kHz. In one embodiment, the cartilage conduction transducer assembly maintains good surface contact with the back of the user's ear and maintains a steady amount of application force (e.g., 1 Newton) to the user's ear. Good surface contact provides maximal translation of vibrations from the transducers to the user's cartilage.

In one embodiment, a transducer is a single piezoelectric transducer. A piezoelectric transducer can generate frequencies up to 20 kHz using a range of voltages around +/−100V. The range of voltages may include lower voltages as well (e.g., +/−10V). The piezoelectric transducer may be a stacked piezoelectric actuator. The stacked piezoelectric actuator includes multiple piezoelectric elements that are stacked (e.g. mechanically connected in series). The stacked piezoelectric actuator may have a lower range of voltages because the movement of a stacked piezoelectric actuator can be a product of the movement of a single piezoelectric element with the number of elements in the stack. A piezoelectric transducer is made of a piezoelectric material that can generate a strain (e.g., deformation in the material) in the presence of an electric field. The piezoelectric material may be a polymer (e.g., polyvinyl chloride (PVC), polyvinylidene fluoroide (PVDF)), a polymer-based composite, ceramic, or crystal (e.g., quartz (silicon dioxide or $SiO_2$), lead zirconate-titanate (PZT)). By applying an electric field or a voltage across a polymer which is a polarized material, the polymer changes in polarization and may compress or expand depending on the polarity and magnitude of the applied electric field. The piezoelectric transducer may be coupled to a material (e.g., silicone) that attaches well to an ear of a user.

In another embodiment, a transducer is a moving coil transducer. A typical moving coil transducer includes a coil of wire and a permanent magnet to produce a permanent magnetic field. Applying a current to the wire while it is placed in the permanent magnetic field produces a force on the coil based on the amplitude and the polarity of the current that can move the coil towards or away from the permanent magnet. The moving coil transducer may be made of a more rigid material. The moving coil transducer may also be coupled to a material (e.g., silicone) that attaches well to an ear of a user.

In some embodiments, the transducer assemblies 310 includes an air transducer assembly. An air conduction transducer assembly is configured to vibrate to generate acoustic pressure waves at an entrance of the user's ear in accordance with audio instructions (e.g., received from the controller 340). The air conduction transducer assembly is in front of an entrance of the user's ear. Optimally, the air conduction transducer assembly is unobstructed being able to generate acoustic pressure waves directly at the entrance of the ear. The air conduction transducer assembly includes at least one transducer (substantially similar to the transducer described in conjunction with the cartilage conduction transducer assembly) to vibrate over a second frequency range to create an acoustic pressure wave in accordance with the audio instructions. Over the second frequency range, the air conduction transducer assembly can vary amplitude of vibration to affect amplitude of acoustic pressure waves produced. For example, the air conduction transducer assembly is configured to vibrate over a second frequency subrange of 8 kHz-20 kHz (or a higher frequency that is hearable by humans).

In some embodiments, the transducer assemblies 310 includes a bone conduction transducer assembly. A bone conduction transducer assembly is configured to vibrate the user's bone to be detected directly by the cochlea in accordance with audio instructions (e.g., received from the controller 340). The bone conduction transducer assembly may be coupled to a portion of the user's bone. In one implementation, the bone conduction transducer assembly is coupled to the user's skull behind the user's ear. In another implementation, the bone conduction transducer assembly is coupled to the user's jaw. The bone conduction transducer assembly includes at least one transducer (substantially similar to the transducer described in conjunction with the cartilage conduction transducer assembly) to vibrate over a third frequency range in accordance with the audio instructions. Over the third frequency range, the bone conduction transducer assembly can vary amplitude of vibration. For example, the bone conduction transducer assembly is configured to vibrate over a third frequency subrange of 100 Hz (or a lower frequency that is hearable by humans)-500 Hz.

The acoustic assembly 320 detects acoustic pressure waves at the entrance of the user's ear. The acoustic assembly 320 comprises one or more acoustic sensors. One or more acoustic sensors may be positioned at an entrance of each ear of a user. The one or more acoustic sensors are configured to detect the airborne acoustic pressure waves formed at an entrance of the user's ears. In one embodiment, the acoustic assembly 320 provides information regarding the produced sound to the controller 340. The acoustic assembly 320 transmits feedback information of the detected acoustic pressure waves to the controller 340.

In one embodiment, the acoustic sensor is a microphone positioned at an entrance of an ear of a user. A microphone is a transducer that converts pressure into an electrical signal. The frequency response of the microphone may be relatively flat in some portions of a frequency range and may be linear in other portions of a frequency range. The microphone may be configured to receive a signal from the controller to scale a detected signal from the microphone based on the audio instructions provided to the transducer assembly 310. For example, the signal may be adjusted based on the audio instructions to avoid clipping of the detected signal or for improving a signal to noise ratio in the detected signal.

In another embodiment, the acoustic sensor 320 may be a vibration sensor. The vibration sensor is coupled to a portion of the ear. In some embodiments, the vibration sensor and the plurality of transducer assemblies 310 couple to different portions of the ear. The vibration sensor is similar to the transducers used in the plurality of transducer assemblies 310 except the signal is flowing in reverse. Instead of an electrical signal producing a mechanical vibration in a transducer, a mechanical vibration is generating an electrical signal in the vibration sensor. A vibration sensor may be made of piezoelectric material that can generate an electrical signal when the piezoelectric material is deformed. The piezoelectric material may be a polymer (e.g., PVC, PVDF), a polymer-based composite, ceramic, or crystal (e.g., $SiO_2$, PZT). By applying a pressure on the piezoelectric material, the piezoelectric material changes in polarization and produces an electrical signal. The piezoelectric sensor may be coupled to a material (e.g., silicone) that attaches well to the back of user's ear. A vibration sensor can also be an accelerometer. The accelerometer may be piezoelectric or capacitive. A capacitive accelerometer measures changes in capacitance between structures which can be moved by an accelerative force. In one embodiment, the vibration sensor maintains good surface contact with the back of the user's ear and maintains a steady amount of application force (e.g., 1 Newton) to the user's ear. The vibration sensor may be an accelerometer. The vibration sensor may be integrated in an internal measurement unit (IMU) integrated circuit (IC). The IMU is further described with relation to FIG. 5.

The input interface 330 provides a user of the audio system 300 an ability to toggle operation of the plurality of transducer assemblies 310. The input interface 330 is an optional component, and in some embodiments is not part of the audio system 300. The input interface 330 is coupled to the controller 340. The input interface 330 provides audio source options for presenting audio content to the user. An audio source option is a user selectable option for having content presented to the user via a specific type or combination of types of transducer assemblies. The audio source options can include an option for toggling any combination of the plurality of transducer assemblies 310. The input interface 330 may provide audio source options as a physical dial for controlling the audio system 300 for selection by the user, as another physical switch (e.g., a slider, a binary switch, etc.), as a virtual menu with options to control the audio system 300, or some combination thereof. In one embodiment of the audio system 300 with two transducer assemblies comprising the plurality of transducer assemblies 310, the audio source options include a first option for the first transducer assembly, a second option for the second transducer assembly, and a third option for a combination of the first transducer assembly and the second transducer assembly. In other embodiments with a third transducer assembly, the audio source options includes additional options for combinations of the first transducer assembly, the second transducer assembly, and the third transducer assembly. The input interface 330 receives a selection of one audio source option of the plurality of audio source options. The input interface 330 sends the received selection to the controller 340.

The controller 340 controls components of the audio system 300. The controller 340 generates audio instructions to instruct the plurality of transducer assemblies 310 how to produce vibrations. For example, audio instructions may include a content signal (e.g., signal applied to any one of the plurality of transducer assemblies 310 to produce a vibration), a control signal to enable or disable any of the plurality of transducer assemblies 310, and a gain signal to scale the content signal (e.g., increase or decrease amplitude of vibrations produced by any of the plurality of transducer assemblies 310).

The controller 340 may further subdivide the audio instructions into different sets of audio instructions for different transducer assemblies of the transducers assemblies 310. A set of audio instructions controls a specific transducer assembly of the transducer assemblies 310. In some embodiments, the controller 340 subdivides the audio instructions for each transducer assembly based on a frequency range for each transducer assembly, based on a received selection of an audio source option from the input interface 330, or based on both the frequency range of each transducer assembly and the received selection of an audio source option. For example, the audio system 300 may comprise a cartilage conduction transducer assembly, an air conduction transducer assembly, and a bone conduction transducer assembly. Following this example, the controller 340 may designate a first set of audio instructions for dictating vibration over a medium range of frequencies for the cartilage conduction transducer assembly, a second set of audio instructions for dictating vibration over a high range of frequencies for the air conduction transducer assembly, and a third set of audio instructions for dictating vibration over a low range of frequencies for the bone conduction transducer assembly. In additional embodiments, the sets of audio instructions instruct the transducer assemblies 310 such that a frequency range of one transducer assembly partially overlaps a frequency range of another transducer assembly.

In another embodiment, the controller 340 subdivides the audio instructions for each transducer based on types of audio within the audio content. Audio content can be categorizes as a particular type. For example, a type of audio may include speech, music, ambient sounds, etc. Each transducer assembly may be configured to present specific types of audio content. In these cases, the controller 340 subdivides the audio content into varying types and, generates audio instructions for each type, and sends the generated audio instructions to the transducer assembly configured to present the corresponding type of audio content.

The controller 340 generates the content signal of the audio instructions based on portions of audio content and a frequency response model. The audio content to be provided may include sounds over the entire range of human hearing. The controller 340 takes the audio content and determines portions of the audio content to be provided by each transducer assembly of the transducer assemblies 310. In one embodiment, the controller 340 determines portions of the audio content for each transducer assembly based on the operable frequency range of that transducer assembly. For example, the controller 340 determines a portion of the audio content within a range of 100 Hz-300 Hz which may be the range of operation for a bone conduction transducer assembly. In another embodiment, the controller 340 determines portions of the audio content for each transducer assembly based on a received selection of an audio source option by the input interface 330. The content signal may comprise a target waveform for vibrating of each of the plurality of transducer assemblies 310. A frequency response model describes the response of audio system 300 to inputs at certain frequencies and may indicate how an output is shifted in amplitude and phase based on the input. With the frequency response model, the controller 340 may adjust the content signal so as to account for the shifted output. Thus, the controller 340 may generate a content signal of the audio instructions with the audio content (e.g., target output) and the frequency response model (e.g., relationship of the input to the output). In one embodiment, the controller 340 may generate the content signal of the audio instructions by applying an inverse of the frequency response to the audio content.

The controller 340 receives feedback from the acoustic assembly 320. The acoustic assembly 320 provides information about the detected acoustic pressure waves produced by one or more of the transducer assemblies of the plurality of transducer assemblies 310. The controller 340 may compare the detected acoustic pressure waves with a target waveform based on audio content to be provided to the user. The controller 340 can then compute an inverse function to apply to the detected acoustic pressure waves such that the detected acoustic pressure waves match the target waveform. Thus, the controller 340 can update the frequency response model of the audio system using the computed inverse function specific to each user. The adjustment of the frequency model may be performed while the user is listening to audio content. The adjustment of the frequency model may also be conducted during a calibration of the audio system 300 for a user. The controller 340 can then generate updated audio instructions using the adjusted frequency response model. By updating audio instructions based on feedback from the acoustic assembly 320, the controller 340 can better provide a similar audio experience across different users of the audio system 300.

In some embodiments of the audio system 300 with any combination of a cartilage conduction transducer assembly, an air conduction transducer assembly, and a bone conduction transducer assembly, the controller 300 updates the audio instructions so as to affect varying changes of operation to each of the transducer assemblies 310. As each auricle of a user is different (e.g., shape and size), the frequency response model will vary from user to user. By adjusting the frequency response model for each user based on audio feedback, the audio system can maintain the same type of produced sound (e.g., neutral listening) regardless of the user. Neutral listening is having similar listening experience across different users. In other words, the listening experience is impartial or neutral to the user (e.g., does not change from user to user).

In another embodiment, the audio system uses a flat spectrum broadband signal to generate the adjusted frequency response model. For example, the controller 340 provides audio instructions to the plurality of transducer assemblies 310 based on a flat spectrum broadband signal. The acoustic assembly 320 detects acoustic pressure waves at the entrance of user's ear. The controller 340 compares the detected acoustic pressure waves with the target waveform based on the flat spectrum broadband signal and adjusts the frequency model of the audio system accordingly. In this embodiment, the flat spectrum broadband signal may be used while performing calibration of the audio system for a particular user. Thus, the audio system may perform an initial calibration for a user instead of continuously monitoring the audio system. In this embodiment, the acoustic assembly 320 may be temporarily coupled to the audio system 300 for calibration of the user.

In some embodiments, the controller 340 manages calibration of the audio system 300. The controller 340 generates calibration instructions for each of the transducer assemblies 310. Calibration instructions may instruct one or more transducer assemblies to generate an acoustic pressure wave that corresponds to a target waveform. In some embodiments, the acoustic pressure wave may correspond to, e.g., a tone or a set of tones. In other embodiments, the acoustic pressure wave may correspond to audio content (e.g., music) that is being presented to the user. The controller 340 may send the calibration instructions to the transducer assemblies 310 one at a time or multiple at a time. As a transducer assembly receives the calibration content, the transducer assembly generates acoustic pressure waves in accordance with the calibration instructions. The acoustic assembly 320 detects the acoustic pressure waves and sends the detected acoustic pressure waves to the controller 340. The controller 340 compares the detected acoustic pressure waves to the target waveform. The controller 340 can then modify the calibration instructions such that the one or more transducer assemblies emit an acoustic pressure wave that is closer to the target waveform. The controller 340 can repeat this process in until the difference between the target waveform and the detected acoustic pressure waves is within some threshold value. In one embodiment where each transducer assembly is calibrated individually, the controller 340 compares the calibration content sent to the transducer assembly against the detected acoustic pressure waves by the acoustic assembly 320. The controller 340 may generate a frequency response model based on the calibration for that transducer assembly. Responsive to completing calibration of the user, the acoustic assembly 320 may be uncoupled from the audio system 300. Advantages of removing the acoustic assembly 320 include making the audio system 300 easier to wear while reducing volume and weight of the audio system 300 and potentially an eyewear device (e.g., eyewear device 100 or eyewear device 200) of which the audio system 300 is a component.

Figure 4:
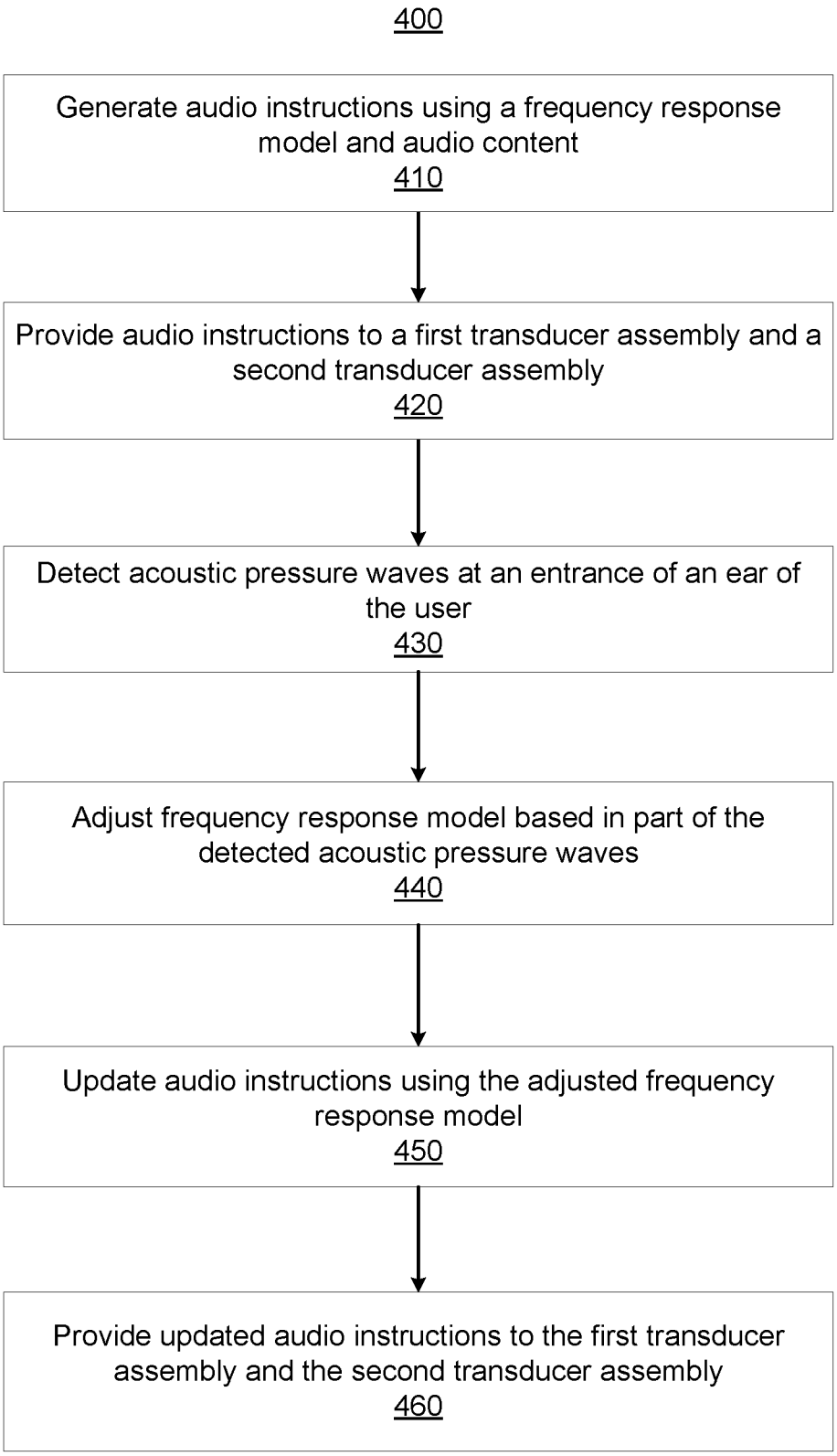
FIG. 4 is a flowchart illustrating a process of operating the audio system, in accordance with one or more embodiments.

FIG. 4 is a flowchart illustrating a process 400 of operating the audio system, in accordance with one or more embodiments. The process 400 of FIG. 4 may be performed by an audio system (or by a controller as a component of the audio system) that comprises at least two transducer assemblies, e.g., a cartilage conduction transducer assembly and an air conduction transducer assembly. Other entities (e.g., an eyewear device and/or console) may perform some or all of the steps of the process in other embodiments. Likewise, embodiments may include different and/or additional steps, or perform the steps in different orders.

The audio system generates 410 audio instructions using a frequency response model and audio content. The audio system may receive audio content from a console. The audio content may include content such as music, radio signal, or calibration signal. The frequency response model describes a relationship between an input (e.g., audio content, audio instructions) and output (e.g., produced audio, sound pressure wave, vibrations) to a user of the audio system. A controller (e.g., the controller 340) may generate the audio instructions using the frequency response model and the audio content. For example, the controller may start with the audio content and use the frequency response model (e.g., apply inverse frequency response) to estimate audio instructions to produce the audio content.

The audio system provides 420 the audio instructions to a first transducer assembly and a second transducer assembly. The first transducer assembly may be configured for bone conduction or cartilage conduction. In embodiments with cartilage conduction, the first transducer assembly is coupled to the back of an auricle of an ear of the user and vibrates the auricle based on the audio instructions. The vibration of the auricle generates a first range of acoustic pressure waves over a first range of frequencies that provides sound based on the audio content to the user. In embodiments with bone conduction, the first transducer assembly is coupled to a portion of bone of the user and vibrates the portion of the bone to create acoustic pressure waves at a cochlea of the user. The second transducer assembly may be configured for air conduction. The second transducer assembly is placed in front of the user's ear and vibrates based on the audio instructions to generate a second range of acoustic pressure waves over a second range of acoustic frequencies.

The audio system detects 430 acoustic pressure waves at the entrance of user's ear. The acoustic pressure waves being generated by the first transducer assembly and the second transducer assembly and noise from an environment of the audio system. In one embodiment, an acoustic sensor (e.g., an acoustic sensor from the acoustic assembly 320) may be a microphone positioned at the entrance of the ear of the user to detect the acoustic pressure waves at the entrance of the user's ear.

The audio system adjusts 440 the frequency response model based in part of the detected acoustic pressure waves. The audio system may compare the detected acoustic pressure waves with a target waveform based on audio content to be provided. The audio system can compute an inverse function to apply to the detected acoustic wave such that the detected acoustic pressure wave appears the same as the target waveform.

The audio system updates 450 audio instructions using the adjusted frequency response model. The updated audio instructions may be generated by the controller which uses audio content and the adjusted frequency response model. For example, the controller may start with audio content and use the adjusted frequency response model to estimate updated audio instructions to produce audio content closer to a target acoustic pressure wave.

The audio system provides 460 the updated audio instructions to the first transducer assembly and the second transducer assembly. The first transducer assembly vibrates the auricle based on the updated audio instructions such that the auricle generates an updated acoustic pressure wave. The second transducer assembly vibrates based on the updated audio instructions to generate an updated acoustic pressure wave as well. The combination of the updated acoustic pressure waves from the first transducer assembly and the second transducer assembly may appear closer to a target waveform based on the audio content to be provided to the user.

Additionally, the audio system dynamically adjusts the frequency response model while the user is listening to audio content or may just adjust the frequency response model during a calibration of the audio system per user.

Figure 5:
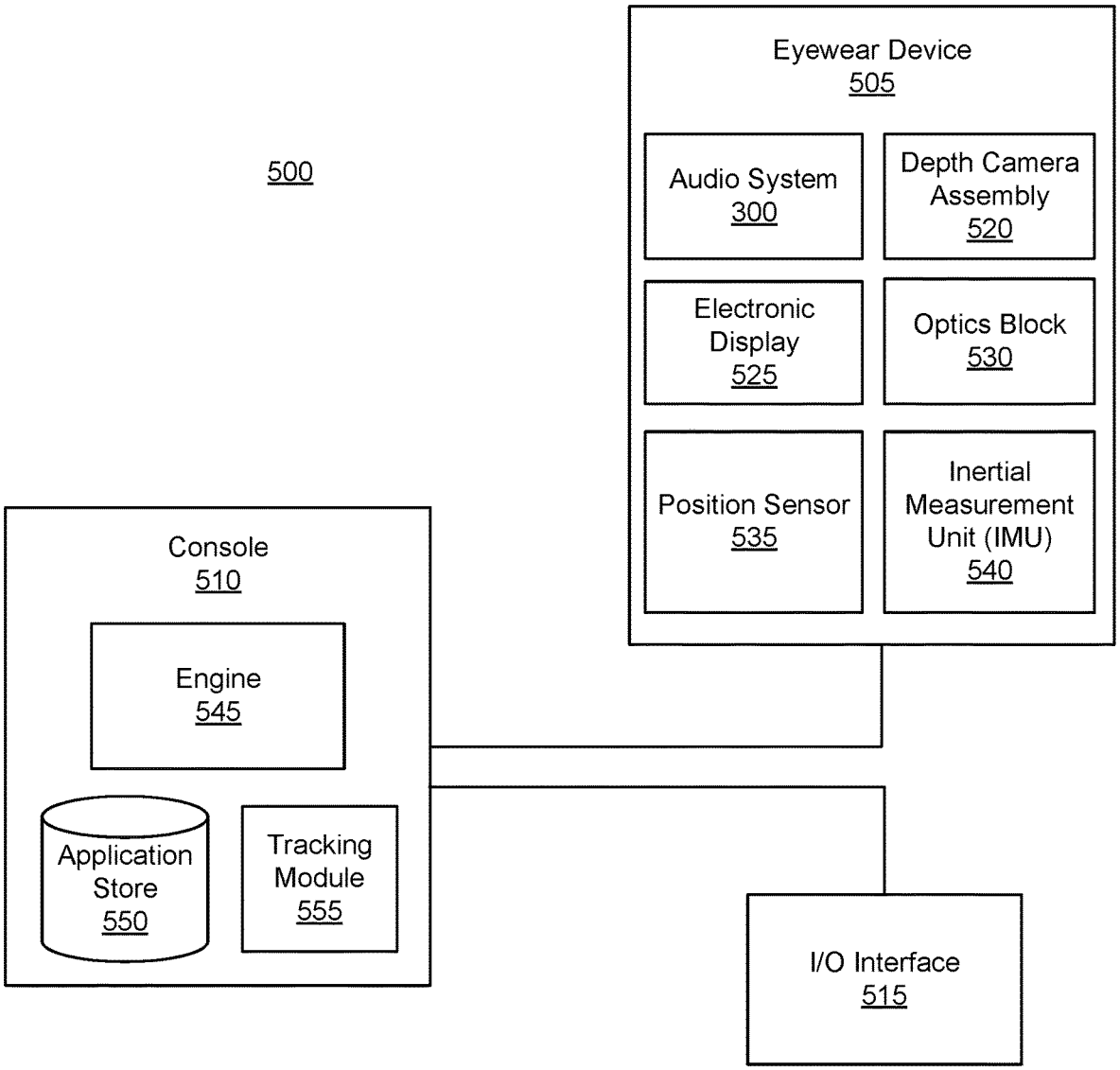
FIG. 5 is a system environment of an eyewear device including an audio system, in accordance with one or more embodiments.

FIG. 5 is a system environment 500 of an eyewear device including an audio system, in accordance with one or more embodiments. The system 500 may operate in an artificial reality environment, e.g., a virtual reality, an augmented reality, a mixed reality environment, or some combination thereof. The system 500 shown by FIG. 5 comprises an eyewear device 505 and an input/output (I/O) interface 515 that is coupled to a console 510. The eyewear device 505 may be an embodiment of the eyewear device 100. While FIG. 5 shows an example system 500 including one eyewear device 505 and one I/O interface 515, in other embodiments, any number of these components may be included in the system 500. For example, there may be multiple eyewear devices 505 each having an associated I/O interface 515 with each eyewear device 505 and I/O interface 515 communicating with the console 510. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 510 is provided by the eyewear device 505.

The eyewear device 505 may be a HMD that presents content to a user comprising augmented views of a physical, real-world environment with computer-generated elements (e.g., two dimensional (2D) or three dimensional (3D) images, 2D or 3D video, sound, etc.). In some embodiments, the presented content includes audio that is presented via an audio system 300 that receives audio information from the eyewear device 505, the console 510, or both, and presents audio data based on the audio information. In some embodiments, the eyewear device 505 presents virtual content to the user that is based in part on a real environment surrounding the user. For example, virtual content may be presented to a user of the eyewear device. The user physically may be in a room, and virtual walls and a virtual floor of the room are rendered as part of the virtual content.

The eyewear device 505 includes the audio system 300 of FIG. 3. The audio system 300 comprises multiple sound conduction methods. As mentioned above, the audio system 300 may include any combination of one or more cartilage conduction transducer assemblies, one or more air conduction transducer assemblies, and one or more bone conduction transducer assemblies. With any combination above, the audio system 300 provides audio content to the user of the eyewear device 505. The audio system 300 may additionally monitor the produced sound so that it can compensate for a frequency response model for each ear of the user and can maintain consistency with produced sound across different individuals using the eyewear device 505.

The eyewear device 505 may include a depth camera assembly (DCA) 520, an electronic display 525, an optics block 530, one or more position sensors 535, and an inertial measurement Unit (IMU) 540. The electronic display 525 and the optics block 530 is one embodiment of a lens 110. The position sensors 535 and the IMU 540 is one embodiment of sensor device 115. Some embodiments of the eyewear device 505 have different components than those described in conjunction with FIG. 5. Additionally, the functionality provided by various components described in conjunction with FIG. 5 may be differently distributed among the components of the eyewear device 505 in other embodiments, or be captured in separate assemblies remote from the eyewear device 505.

The DCA 520 captures data describing depth information of a local area surrounding some or all of the eyewear device 505. The DCA 520 may include a light generator, an imaging device, and a DCA controller that may be coupled to both the light generator and the imaging device. The light generator illuminates a local area with illumination light, e.g., in accordance with emission instructions generated by the DCA controller. The DCA controller is configured to control, based on the emission instructions, operation of certain components of the light generator, e.g., to adjust an intensity and a pattern of the illumination light illuminating the local area. In some embodiments, the illumination light may include a structured light pattern, e.g., dot pattern, line pattern, etc. The imaging device captures one or more images of one or more objects in the local area illuminated with the illumination light. The DCA 520 can compute the depth information using the data captured by the imaging device or the DCA 520 can send this information to another device such as the console 510 that can determine the depth information using the data from the DCA 520.

The electronic display 525 displays 2D or 3D images to the user in accordance with data received from the console 510. In various embodiments, the electronic display 525 comprises a single electronic display or multiple electronic displays (e.g., a display for each eye of a user). Examples of the electronic display 525 include: a liquid crystal display (LCD), an organic light emitting diode (OLED) display, an active-matrix organic light-emitting diode display (AMOLED), some other display, or some combination thereof.

The optics block 530 magnifies image light received from the electronic display 525, corrects optical errors associated with the image light, and presents the corrected image light to a user of the eyewear device 505. In various embodiments, the optics block 530 includes one or more optical elements. Example optical elements included in the optics block 530 include: a waveguide, an aperture, a Fresnel lens, a convex lens, a concave lens, a filter, a reflecting surface, or any other suitable optical element that affects image light. Moreover, the optics block 530 may include combinations of different optical elements. In some embodiments, one or more of the optical elements in the optics block 530 may have one or more coatings, such as partially reflective or anti-reflective coatings.

Magnification and focusing of the image light by the optics block 530 allows the electronic display 525 to be physically smaller, weigh less, and consume less power than larger displays. Additionally, magnification may increase the field of view of the content presented by the electronic display 525. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 530 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 525 for display is pre-distorted, and the optics block 530 corrects the distortion when it receives image light from the electronic display 525 generated based on the content.

The IMU 540 is an electronic device that generates data indicating a position of the eyewear device 505 based on measurement signals received from one or more of the position sensors 535. A position sensor 535 generates one or more measurement signals in response to motion of the eyewear device 505. Examples of position sensors 535 include: one or more accelerometers, one or more gyroscopes, one or more magnetometers, another suitable type of sensor that detects motion, a type of sensor used for error correction of the IMU 540, or some combination thereof. The position sensors 535 may be located external to the IMU 540, internal to the IMU 540, or some combination thereof.

Based on the one or more measurement signals from one or more position sensors 535, the IMU 540 generates data indicating an estimated current position of the eyewear device 505 relative to an initial position of the eyewear device 505. For example, the position sensors 535 include multiple accelerometers to measure translational motion (forward/back, up/down, left/right) and multiple gyroscopes to measure rotational motion (e.g., pitch, yaw, and roll). In some embodiments, the IMU 540 rapidly samples the measurement signals and calculates the estimated current position of the eyewear device 505 from the sampled data. For example, the IMU 540 integrates the measurement signals received from the accelerometers over time to estimate a velocity vector and integrates the velocity vector over time to determine an estimated current position of a reference point on the eyewear device 505. Alternatively, the IMU 540 provides the sampled measurement signals to the console 510, which interprets the data to reduce error. The reference point is a point that may be used to describe the position of the eyewear device 505. The reference point may generally be defined as a point in space or a position related to the eyewear device's 505 orientation and position.

The I/O interface 515 is a device that allows a user to send action requests and receive responses from the console 510. An action request is a request to perform a particular action.

For example, an action request may be an instruction to start or end capture of image or video data, or an instruction to perform a particular action within an application. The I/O interface 515 may include one or more input devices. Example input devices include: a keyboard, a mouse, a game controller, or any other suitable device for receiving action requests and communicating the action requests to the console 510. An action request received by the I/O interface 515 is communicated to the console 510, which performs an action corresponding to the action request. In some embodiments, the I/O interface 515 includes an IMU 540, as further described above, that captures calibration data indicating an estimated position of the I/O interface 515 relative to an initial position of the I/O interface 515. In some embodiments, the I/O interface 515 may provide haptic feedback to the user in accordance with instructions received from the console 510. For example, haptic feedback is provided when an action request is received, or the console 510 communicates instructions to the I/O interface 515 causing the I/O interface 515 to generate haptic feedback when the console 510 performs an action.

The console 510 provides content to the eyewear device 505 for processing in accordance with information received from one or more of: the eyewear device 505 and the I/O interface 515. In the example shown in FIG. 5, the console 510 includes an application store 550, a tracking module 555 and an engine 545. Some embodiments of the console 510 have different modules or components than those described in conjunction with FIG. 5. Similarly, the functions further described below may be distributed among components of the console 510 in a different manner than described in conjunction with FIG. 5.

The application store 550 stores one or more applications for execution by the console 510. An application is a group of instructions, that when executed by a processor, generates content for presentation to the user. Content generated by an application may be in response to inputs received from the user via movement of the eyewear device 505 or the I/O interface 515. Examples of applications include: gaming applications, conferencing applications, video playback applications, or other suitable applications.

The tracking module 555 calibrates the system environment 500 using one or more calibration parameters and may adjust one or more calibration parameters to reduce error in determination of the position of the eyewear device 505 or of the I/O interface 515. Calibration performed by the tracking module 555 also accounts for information received from the IMU 540 in the eyewear device 505 and/or an IMU 540 included in the I/O interface 515. Additionally, if tracking of the eyewear device 505 is lost, the tracking module 555 may re-calibrate some or all of the system environment 500.

The tracking module 555 tracks movements of the eyewear device 505 or of the I/O interface 515 using information from the one or more position sensors 535, the IMU 540, the DCA 520, or some combination thereof. For example, the tracking module 555 determines a position of a reference point of the eyewear device 505 in a mapping of a local area based on information from the eyewear device 505. The tracking module 555 may also determine positions of the reference point of the eyewear device 505 or a reference point of the I/O interface 515 using data indicating a position of the eyewear device 505 from the IMU 540 or using data indicating a position of the I/O interface 515 from an IMU 540 included in the I/O interface 515, respectively. Additionally, in some embodiments, the tracking module 555 may use portions of data indicating a position or the eyewear device 505 from the IMU 540 to predict a future location of the eyewear device 505. The tracking module 555 provides the estimated or predicted future position of the eyewear device 505 or the I/O interface 515 to the engine 545.

The engine 545 also executes applications within the system environment 500 and receives position information, acceleration information, velocity information, predicted future positions, or some combination thereof, of the eyewear device 505 from the tracking module 555. Based on the received information, the engine 545 determines content to provide to the eyewear device 505 for presentation to the user. For example, if the received information indicates that the user has looked to the left, the engine 545 generates content for the eyewear device 505 that mirrors the user's movement in a virtual environment or in an environment augmenting the local area with additional content. Additionally, the engine 545 performs an action within an application executing on the console 510 in response to an action request received from the I/O interface 515 and provides feedback to the user that the action was performed. The provided feedback may be visual or audible feedback via the eyewear device 505 or haptic feedback via the I/O interface 515.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An audio system comprising:

a first transducer assembly of a plurality of transducer assemblies coupled to a back portion of a pinna of an ear of a user, the first transducer assembly including a transducer that is configured to vibrate the pinna over a first range of frequencies to cause the pinna to create a first range of airborne acoustic pressure waves at an entrance of an ear canal of the ear based on a first set of audio instructions;

a second transducer assembly of the plurality of transducer assemblies including a transducer that is configured to vibrate over a second range of frequencies to produce a second range of acoustic pressure waves based on a second set of audio instructions; and a controller coupled to the plurality of transducer assemblies, the controller configured to generate the first set of audio instructions and the second set of audio instructions such that the first range of airborne acoustic pressure waves and the second range of acoustic pressure waves together form at least a portion of audio content to be provided to the user.

2. The audio system of claim 1, wherein the first range of airborne acoustic pressure waves is different from the second range of acoustic pressure waves.

3. The audio system of claim 2, wherein the first range of airborne acoustic pressure waves partially overlaps the second range of acoustic pressure waves.

4. The audio system of claim 2, wherein the first range of frequencies has a lower frequency than a frequency of the second range of frequencies.

5. The audio system of claim 1, wherein the first set of audio instructions are designated to provide a first portion of the audio content corresponding to a first type of audio, and wherein the second set of audio instructions are designated to provide a second portion of the audio content corresponding to a second type of audio that is different from the first type of audio.

6. The audio system of claim 1, further comprising:

an input interface coupled to the controller and configured to:

provide audio source options for presenting audio content to the user, the audio source options selected from a group including: the first transducer assembly, the second transducer assembly, a combination of the first transducer assembly and the second transducer assembly, and wherein responsive to receiving a selection of an audio source option of the audio source options, the controller presents audio content using the selected audio source.

7. The audio system of claim 1, wherein the second transducer assembly comprises a transducer selected from a group consisting of: a piezoelectric transducer and a voice coil transducer.

8. The audio system of claim 1, further comprising an acoustic sensor configured to detect acoustic pressure waves at the entrance of the ear canal of the ear, wherein the detected acoustic pressure waves includes the first range of airborne acoustic pressure waves and the second range of acoustic pressure waves.

9. The audio system of claim 8, wherein the controller is further configured to update audio instructions based on a frequency response model, wherein the frequency response model is based on a comparison of the detected acoustic pressure waves to the audio content to be provided to the user.

10. The audio system of claim 9, wherein the frequency response model is generated using a flat broadband signal.

11. The audio system of claim 8, wherein the acoustic sensor is a vibration sensor coupled to the pinna of the ear of the user and the acoustic sensor is configured to monitor a vibration of the pinna corresponding to the detected acoustic pressure waves at the entrance of the ear canal of the ear of the user.

12. The audio system of claim 11, wherein the controller modifies the first set of audio instructions based in part on the monitored vibration of the pinna.

13. The audio system of claim 11, wherein the controller modifies the second set of audio instructions based in part on the monitored vibration of the pinna.

14. The audio system of claim 1 further comprising:

a third transducer assembly of the plurality of transducer assemblies, the third transducer assembly coupled to a portion of a bone behind the ear of the user, and the third transducer assembly includes a transducer that is configured to vibrate the bone over a third range of frequencies based on a third set of audio instructions provided by the controller, wherein the first transducer assembly is configured for cartilage conduction, the second transducer assembly is configured for air conduction, and the third transducer assembly is configured for bone conduction.

15. The audio system of claim 1, wherein the first transducer assembly and the second transducer assembly are clear of the entrance of the ear canal of the ear.

16. The audio system of claim 1, wherein the audio system is a component of an eyewear device.

17. A method comprising:

generating a first set of audio instructions and a second set of audio instructions based on audio content to be provided to a user;

providing the first set of audio instructions to a first transducer assembly of a plurality of transducer assemblies, wherein the first set of audio instructions instructs the first transducer assembly to vibrate a pinna of an ear of the user over a first range of frequencies to cause the pinna of the ear to create a first range of airborne acoustic pressure waves at an entrance of an ear canal of the ear; and providing the second set of audio instructions to a second transducer assembly of the plurality of transducer assemblies, wherein the second set of audio instructions instructs the second transducer assembly to vibrate so as to produce a second range of acoustic pressure waves at the entrance of the ear canal of the ear; wherein the first range of airborne acoustic pressure waves and the second range of acoustic pressure waves together form at least a portion of the audio content to be provided to the user.

18. The method of claim 17, further comprising:

monitoring acoustic pressure waves at the entrance of the ear canal of the ear of the user, wherein the monitored acoustic pressure waves include the first range of airborne acoustic pressure waves and the second range of acoustic pressure waves; and modifying one of the first set of audio instructions and the second set of audio instructions based on the monitored acoustic pressure waves.

19. A non-transitory computer-readable storage medium storing executable computer program instructions, the computer program instructions executable by a processor to perform steps comprising:

generating a first set of audio instructions and a second set of audio instructions based on audio content to be provided to a user;

providing the first set of audio instructions to a first transducer assembly of a plurality of transducer assemblies, wherein the first set of audio instructions instructs the first transducer assembly to vibrate a pinna of an ear of the user over a first range of frequencies to cause the pinna of the ear to create a first range of airborne acoustic pressure waves at an entrance of an ear canal of the ear; and providing the second set of audio instructions to a second transducer assembly of the plurality of transducer assemblies, wherein the second set of audio instructions instructs the second transducer assembly to vibrate so as to produce a second range of acoustic pressure waves at the entrance of the ear canal of the ear; wherein the first range of airborne acoustic pressure waves and the second range of acoustic pressure waves together form at least a portion of the audio content to be provided to the user.

20. The storage medium of claim 19, the steps further comprising:

monitoring acoustic pressure waves at the entrance of the ear canal of the ear of the user, wherein the monitored acoustic pressure waves include the first range of airborne acoustic pressure waves and the second range of acoustic pressure waves; and modifying one of the first set of audio instructions and the second set of audio instructions based on the monitored acoustic pressure waves.

* * * * *